US006389256B2

(12) United States Patent
Song et al.

(10) Patent No.: US 6,389,256 B2
(45) Date of Patent: May 14, 2002

(54) LIQUID ELECTROPHOTOGRAPHIC COLOR IMAGE FORMING APPARATUS AND COLOR IMAGE FORMING METHOD FOR REDUCING THE TRANSFER OF TONER TO A DEVELOPING ROLLER

(75) Inventors: In-yong Song, Suwon; Kyu-cheol Shin, Kwacheon, both of (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/770,236

(22) Filed: Jan. 29, 2001

(30) Foreign Application Priority Data

Mar. 29, 2000 (KR) ..... 00-16074

(51) Int. Cl.[7] ..... G03G 15/10; G03G 15/08
(52) U.S. Cl. ..... 399/237; 399/299
(58) Field of Search ..... 399/299, 57, 237

(56) References Cited

U.S. PATENT DOCUMENTS 5,444,525 A * 8/1995 Takahashi et al. ..... 399/76
5,933,689 A * 8/1999 Kim ..... 399/233
5,940,665 A * 8/1999 Domoto et al. ..... 399/249

FOREIGN PATENT DOCUMENTS

JP 58-100870 A * 6/1983
JP 8-123205 A * 5/1996
JP 63-237079 A * 10/1998

* cited by examiner

*Primary Examiner*—Quana M. Grainger
(74) *Attorney, Agent, or Firm*—Sughrue Mion, PLLC

(57) ABSTRACT

A liquid electrophotographic color image forming apparatus includes a main charger for charging a surface of a photoreceptor web to a predetermined charging electric potential, an optical scanning unit for scanning light onto the photoreceptor web to form an electrostatic latent image, and developing rollers for yellow, cyan, magenta and black colors, sequentially installed in a direction that the photoreceptor web circulates, for developing the electrostatic latent image using developer for each color. Further included are auxiliary chargers for cyan, magenta and black colors, installed downstream of each of the developing rollers, for additionally charging the photoreceptor web, the electric potential of which is lowered after development for each of yellow, cyan and magenta colors. In the above apparatus, when development gaps between each of the developing rollers and the photoreceptor web are respectively defined as $G_Y$, $G_C$, $G_M$ and $G_K$ sequentially in a direction that the photoreceptor web proceeds, to restrict an increase of the intensity of an electric field at each development gap according to the additional charging, each of the developing rollers are installed to satisfy the condition that $G_Y \leqq G_C \leqq G_M \leqq G_K$.

17 Claims, 11 Drawing Sheets

FIGI. 9A

LIQUID ELECTROPHOTOGRAPHIC COLOR IMAGE FORMING APPARATUS AND COLOR IMAGE FORMING METHOD FOR REDUCING THE TRANSFER OF TONER TO A DEVELOPING ROLLER

BACKGROUND OF THE INVENTION

1. Field of the Invention

The present invention relates to a liquid electrophotographic color image forming apparatus and a color image forming method and, more particularly, to a liquid electrophotographic image forming apparatus and method which prevents toner from a color image from being transferred to a developing roller.

2. Description of the Related Art

In a typical liquid electrophotographic image forming apparatus, an image is formed on a photoreceptor medium such as a photoreceptor web by using developer in which toner powder having a predetermined color and liquid carrier are mixed, and the image is printed on a sheet of print paper. To form and print an image, the image forming apparatus adopts the basic processes of discharging, charging, exposure, development, drying and transfer. Also, in the color image forming apparatus for forming a color image on a photoreceptor web, the exposure and development steps are usually repeated four times. With the trend toward high speed image forming apparatuses, four optical scanning units and four developing units are provided so that the exposure and development steps can be repeated four times during one turn of the photoreceptor web, that is, one cycle. The respective development units include developing rollers for sequentially developing a latent image formed on the photoreceptor web using developer for yellow (Y), cyan (C), magenta (M) and black (K) colors. A conventional liquid electrophotographic color image forming apparatus having the developing rollers is shown in FIG. 1.

Referring to FIG. 1, a photoreceptor web 10 is installed to be capable of circulating around a plurality of rollers 11. Devices for performing the above basic processes are sequentially installed around the photoreceptor web 10 in the direction that the photoreceptor web 10 circulates. These devices are a discharger 8, a main charger 9, four optical scanning units 12*a*–12*d* and four developing units 13*a*–13*d* alternately installed color by color, a drying unit 17, and a transfer unit 19. The units 13*a*–13*d* are provided with developing rollers 15*a*–15*d* and squeegee rollers 14, respectively. The squeegee rollers 14 remove carrier from the developer on the photoreceptor web 10. Each of the developing rollers 15*a*–15*d* is installed to be separated from the photoreceptor web 10 by the same distance, i.e., developing gap (G). Also, an auxiliary charger such as a topping corona 16 is installed near the photoreceptor web 10 downstream from each of the developing units 13*a*–13*d*. The auxiliary charger compensates for natural attenuation of the level of charging electric potential, by further charging the photoreceptor web 10.

In the operation of the conventional liquid electrophotographic color image forming apparatus, first, while the photoreceptor web 10 circulates at a constant speed, the discharger 8 removes a remaining charge component. Next, the surface of the photoreceptor web 10 is charged to a charging electric potential of about 650–700V by the main charger 9. The surface of the photoreceptor web 10 is exposed to light scanned by the optical scanning units 12*a*–12*d* which are installed in order of color under the photoreceptor web 10. An electrostatic latent image corresponding to image data for each color is formed on the sequentially exposed photoreceptor web 10. The electrostatic latent image for each color is developed using developer which is supplied through a manifold 7 while passing each of the developing units 13*a*–13*d*. About 60–70% of carrier in the developer used in the development is squeegeed by the squeegee rollers 14 and removed from the photoreceptor web 10. The remaining carrier is vaporized by the drying unit 17. Also, the toner powder in the developer used in the development is made filmy by the squeegee roller 14 and is used for forming a toner image. The toner image is finally printed on a sheet of print paper P via the transfer unit 19.

The image forming method using the developing units 13*a*–13*d* for each color is described in detail referring to an electric potential model related to the charging property.

That is, as shown in FIG. 2A, the photoreceptor web 10 is charged to a charging electric potential $V_{CY}$ of about 560–700V by the main charger 9. Next, the photoreceptor web 10 is primarily exposed to light scanned by the optical scanning unit 12*a* for a yellow (Y) color and the electric potential of the surface of the exposed photoreceptor web 10 is lowered to an exposure electric potential $V_e$ of about 120V. An electrostatic latent image corresponding to the yellow image data is formed at a predetermined portion of the photoreceptor web 10 with electric potential lowered. Developer for the yellow color is supplied to an electrostatic latent image for the yellow color formed as above, through the developing roller 15*a* for the yellow color, and simultaneously, a development electric potential $V_d$ of about 450V is applied to the developing roller 15*a*. The charged toner component moves to the electrostatic latent image for the yellow color due to the difference in the electric potential between the exposure electric potential $V_e$ and the development electric potential $V_d$, so that an image 10*a* for the yellow color is formed. When the electric potential of the toner component adhering to the yellow image 10*a* becomes almost the same as the development electric potential $V_d$, the development does not continue any more, that is, balance in charge is achieved. The developed yellow image 10*a* becomes filmy by the squeegee roller 14 in a squeegeeing process. The filmy yellow image 10*a*, about 60–70% of its carrier being removed, remains on the photoreceptor web 10.

The charging electric potential of the photoreceptor web 10 naturally attenuates while passing the yellow developing unit 13*a* prior to entering a cyan (C) image forming step. Thus, to compensate for the attenuation in the level of the charging electric potential of the photoreceptor web 10, the topping corona 16, an auxiliary charger, further charges the photoreceptor web 10. Referring to FIG. 2B, the charging electric potential $V_{CC}$ of the photoreceptor web 10 which is further charged is higher than the charging electric potential $V_{CY}$ prior to the formation of the yellow image 10*a*. Also, even when the yellow image 10*a* is further charged, the electric potential thereof is lower than the charging electric potential $V_{CY}$.

In this state, the optical scanning unit 12*b* for a cyan color scans light to the photoreceptor web 10 to form an electrostatic latent image for the cyan color. The development electric potential $V_d$ is applied to the developing roller 15*b*, and simultaneously, developer for the cyan color is supplied to the developing roller 15*b*. Then, the difference in the electric potential between the development electric potential $V_d$ and the exposure electric potential $V_e$ causes the charged toner of the cyan developer to move to the cyan electric potential due to the difference in the electric potential so that a cyan image 10*b* is formed. Here, a difference in the electric potential between the yellow image 10*a* formed in the previous step and the cyan developing roller 15*b* occurs. As a result, a wash-off phenomenon where some of toner of the yellow image 10*a* is transferred back to the cyan developing roller 15*b* due to an electric field generated by the different electric potentials occurs.

Also, when an image 10*b* for the cyan color is formed, the photoreceptor web 10 is further charged to form an image for a magenta color. Then, an electrostatic latent image for the magenta color is formed on the photoreceptor web 10. As shown in FIG. 2C, the electric potential $V_{CM}$ of the photoreceptor web 10 is higher than the electric potential $V_{CC}$ in the previous step. Also, the electric potential levels of both the yellow image 10*a* and the cyan image 10*b* are higher than the development electric potential $V_d$ of the developing roller 15*c* for the magenta color. In particular, the difference in the electric potential between the yellow image 10*a* and the magenta developing roller 15*c* is much greater due to the additional two previously performed charging steps. Accordingly, the difference in the electric potential between the yellow image 10*a* and the magenta developing roller 15*c* becomes greater than that in the step of forming the cyan image 10*b*. Consequently, the wash-off phenomenon is generated more severely than in the step of forming the cyan image 10*b*.

Also, as shown in FIG. 2D, one more charging step is performed in forming an image 10*d* for a black color. The charging electric potential $V_{CK}$ of the further charged photoreceptor web 10 is higher than the previous charging electric potential $V_{CM}$, and higher still than the original charging electric potential $V_{CY}$. Furthermore, the respective yellow, cyan and magenta images 10*a*, 10*b* and 10*c* have different electric potentials with respect to the developing roller 15*d* for the black color. In this case, even when the same development gap (G) between each developing roller and the photoreceptor web 10 is maintained, as the development unit is installed closer downstream from the previous developing unit, the difference in the electric potential between the developing roller and each image becomes greater. Thus, a more severe wash-off phenomenon is generated in proportion to the difference in the electric potential from the yellow developing roller 15*a* to the black developing roller 15*d*.

When the wash-off phenomenon is generated, some of the toner components of the respective images 10*a*–10*c* formed at an appropriate concentration by the developing rollers 15*a*–15*c* is washed off onto the respective developing rollers 15*b*–15*d* when the next color is developed. Accordingly, the images 10*a*–10*c* lack the appropriate concentration. Thus, the respective images 10*a*–10*c* become partially missing or tainted. As a result, when the color image is printed on a sheet of print paper, an incomplete print image is obtained.

Also, the toner washed off from the respective images 10*a*–10*c* is mixed with the developer contained in the respective developing units 13*b*–13*d*. Then, the developer of each of the developing units 13*b*–13*d* is contaminated, and developer contaminated beyond a predetermined limit must be replaced. Thus, the period for using the developer is shortened and, thus the cost therefor increases.

SUMMARY OF THE INVENTION

To solve the above problems, it is an object of the present invention to provide a liquid electrophotographic color image forming method and apparatus in which a strength of an electric field generated by a difference in an electric potential between an image formed on a photoreceptor web and a developing roller can be constantly maintained.

Accordingly, to achieve the above object, there is provided a liquid electrophotographic color image forming apparatus comprising a photoreceptor web which is operative to circulate, a main charger for charging a surface of the photoreceptor web to a predetermined charging electric potential, and an optical scanning unit for scanning light onto the photoreceptor web to form an electrostatic latent image. Also provided are developing rollers for yellow, cyan, magenta and black colors, sequentially installed in a direction that the photoreceptor web circulates. The developing rollers develop the electrostatic latent image using developer for each color, and auxiliary chargers for the cyan, magenta and black colors, respectively, installed downstream of each of the developing rollers, which additionally charge the photoreceptor web, the electric potential of which is lowered after development for each of the yellow, cyan and magenta colors. Development gaps provided between each of the developing rollers and the photoreceptor web are respectively defined as $G_Y$, $G_C$, $G_M$ and $G_K$ sequentially in a direction that the photoreceptor web circulates. The development gaps are operative to restrict an increase of an intensity of an electric field at each development gap according to the additional charge, such that each of the developing rollers are installed to satisfy the condition of $G_Y \leqq G_C \leqq G_M \leqq G_K$.

It is preferred in the present invention that the apparatus further comprises at least one light emitting body, installed between one of the developing rollers and one of the auxiliary chargers, for forcibly lowering the electric potential of the photoreceptor web after passing the developing roller.

To achieve the above object, there is provided a method of forming a color image comprising the steps of charging a photoreceptor web to a predetermined charging electric potential, and providing each of a plurality of optical scanning units which are installed in order of yellow, cyan, magenta and black colors, scanning light onto the photoreceptor web to sequentially form electrostatic latent images corresponding to the respective colors. The electrostatic latent images are sequentially developed using yellow, cyan, magenta and black developer applied from yellow, cyan, magenta and black developing rollers. The developer used for the development is squeegeed by squeegee rollers, one of which is installed downstream of each of the developing rollers. The photoreceptor web having a lowered electric potential after squeegeeing, is additionally charged by using an auxiliary charger, and the developer used for the development on the photoreceptor web is restricted from being transferred to a developing roller.

Also, it is preferred in the present invention that the step of restricting developer from being transferred back to the next developing roller further comprises a step of maintaining a magnitude of an electric field at each of the development gaps between each developing roller and the photoreceptor web within a predetermined range.

Also, it is preferred in the present invention that the step of maintaining the magnitude of an electric field further comprises the steps of installing the developing rollers such that the sizes of the development gaps between each of the yellow, cyan, magenta and black developing rollers and the photoreceptor web can be increased, and maintaining the difference in the electric potential between the photoreceptor web and each of the developing rollers at each development gap to be 150V or less, in which an increase of the difference in the electric potential at each of the development gaps according to the additional charging is compensated for by an increase in size of the development gap.

BRIEF DESCRIPTION OF THE DRAWINGS

The above object and advantages of the present invention will become more apparent by describing in detail a preferred embodiment thereof with reference to the attached drawings, in which:

FIGS. 7A–7B, 8A–8C, 9A–9C and 10A–10B are graphs showing the state of the charged photoreceptor web according to the steps of forming yellow, cyan, magenta and black color images.

DETAILED DESCRIPTION OF THE PREFERRED EMBODIMENTS

Figure 3:
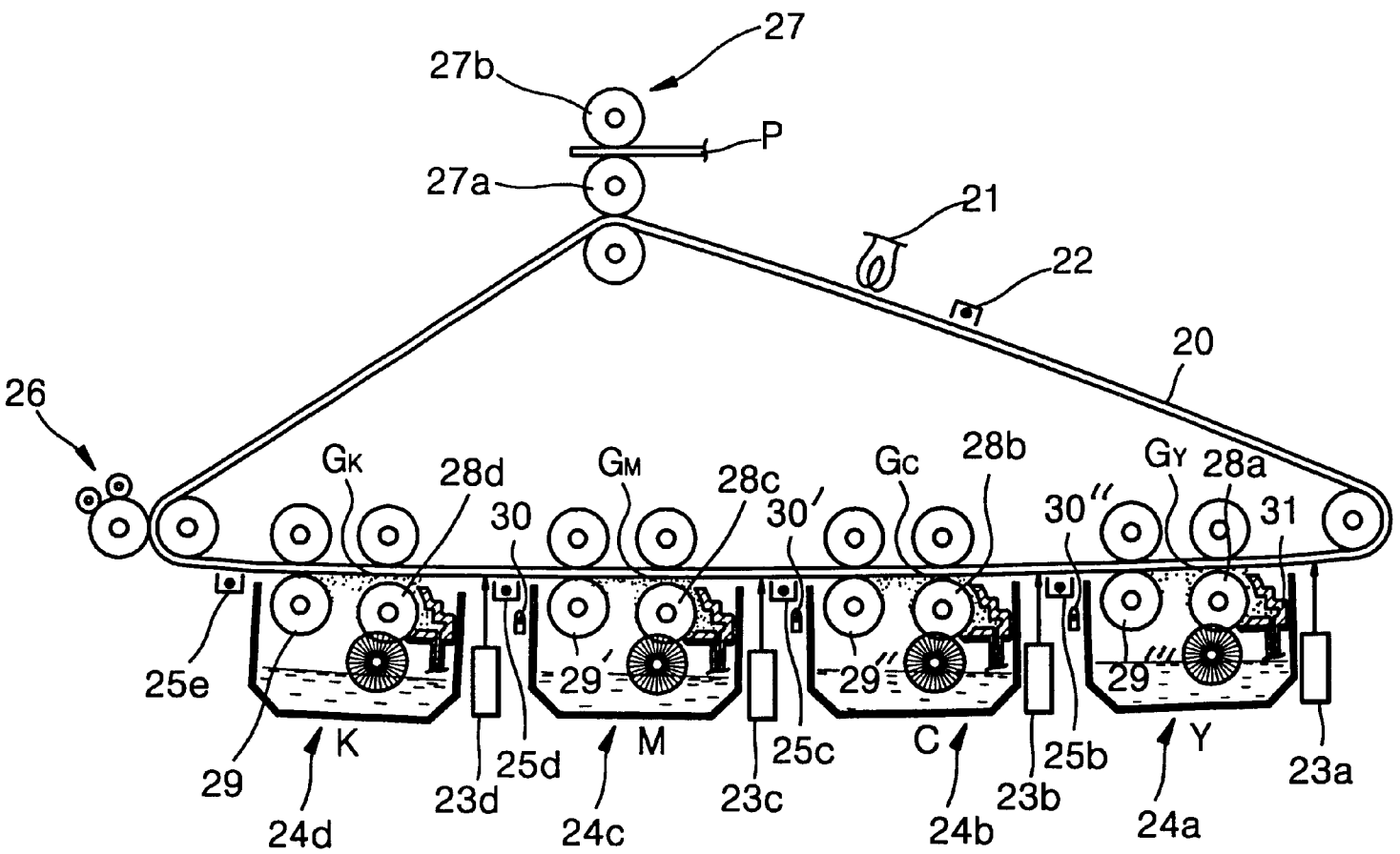
FIG. 3 is a view showing the configuration of a liquid electrophotographic color image forming apparatus according a preferred embodiment of the present invention.

Referring to FIG. 3, an image forming apparatus according to a preferred embodiment of the present invention includes a main discharger 21, a main charger 22, a plurality of optical scanning units 23*a*–23*d*, developing units 24*a*–24*d*, respectively, for yellow (Y), cyan (C), magenta (M) and black (K) colors, and auxiliary chargers 25*b*–25*d*, respectively, for cyan, magenta and black colors, which are sequentially installed in the direction that a photoreceptor web 20 circulates.

A drying unit 26 and a transfer unit 27 are installed at one side of the photoreceptor web 20. The drying unit 26 dries an image formed on the photoreceptor web 20. The transfer unit 27 includes a transfer roller 27*a* and a fusing roller 27*b*. The image formed on the photoreceptor web 20 passes between the transfer roller 27*a* and the fusing roller 27*b* and is transferred to a sheet of print paper P.

The main discharger 21 initializes a state of electric potential of the photoreceptor web 20 having passed the transfer unit 27. The main charger 22 charges the surface of the initialized photoreceptor web 20 to a charging electric potential of about 650–700V.

The optical scanning units 23*a*–23*d* are installed to alternate with the developing units 24*a*–24*d*. Each of the optical scanning units 23*a*–23*d* scans light onto the photoreceptor web 20 to make the photoreceptor web 20 partially exposed. Thus, an electrostatic latent image corresponding to image data for each color is formed on the partially exposed photoreceptor web 20.

The developing units 24*a*–24*d* include developing rollers 28*a*–28*d* for yellow, cyan, magenta and black colors for developing an electrostatic latent image for each color formed on the photoreceptor web 20 with developer corresponding to each color, and squeegee rollers 29, 29', 29" and 29'" for squeegeeing the developer used for development. A development electric potential of about 400–550V is applied to each of the developing rollers 28*a*–28*d* during development. Each of the developing rollers 28*a*–28*d* is provided with a manifold 31. Developer, which is a mixture of toner powder and liquid carrier, is supplied through the manifold 31. The toner component of the supplied developer is charged by the development electric potential. The charged toner component is moved to the electrostatic latent image on the photoreceptor web 20 due to the difference between an exposure electric potential of the electrostatic latent image and the development electric potential, and is used for the development of the electrostatic latent image.

The photoreceptor web 20 is further charged by the auxiliary chargers 25*b*–25*d* while it passes each of the developing units 24*a*–24*d*. The level of the charging electric potential of the photoreceptor web 20 increases as the photoreceptor web 20 is additionally charged. In contrast, the development electric potential applied to the respective developing rollers 28*a*–28*d* is almost constant. Thus, an increase in the intensity of an electric field formed by the difference in the electric potential between each of the developing rollers 28*a*–28*d* and the photoreceptor web 20 must be restricted. For this purpose, each of the developing rollers 28*a*–28*d* is installed to satisfy the following conditions.

$$G_Y \leqq G_C \leqq G_M \leqq G_K \qquad \text{[Condition 1]}$$

Here, $G_Y$ signifies a gap between the developing roller 28*a* for the yellow color and the photoreceptor web 20, $G_C$ signifies a gap between the developing roller 28*b* for the cyan color and the photoreceptor web 20, $G_M$ signifies a gap between the developing roller 28*c* for the magenta color and the photoreceptor web 20, and $G_K$ signifies a gap between the developing roller 28*d* for the black color and the photoreceptor web 20. Also, the developing rollers 28*a*–28*d* are installed to rotate while maintaining the developing gaps with respect to the photoreceptor web 20. Also, the development gap may be about 50–300 $\mu$m. Preferably, $G_Y$ and $G_C$ have the same distance of about 150 $\mu$m. Also, $G_M$ and $G_K$ have the same distance of about 200 $\mu$m which is greater than $G_Y$ and $G_C$. Since the development gaps have different sizes, even when the charging electric potential of the photoreceptor web 20 increases, the electric field at each development gap can be constantly maintained.

The auxiliary chargers 25*b*–25*d* are alternately installed near to and on the downstream side of each of the development units 24*a*–24*c*. The auxiliary chargers 25*b*–25*d*, such as topping coronas, are for additional charging of the photoreceptor web 20, which compensates for the natural attenuation of the electric potential of the photoreceptor web 20 during the development performed with developer for each color.

Also, a predetermined light emitting body 30, 30' and 30" is installed upstream of each of the auxiliary chargers 25*b*–25*d*, that is, close downstream to each of the developing units 24*a*–24*c*, except for the developing unit 24*d* for the black color. The light emitting body 30, 30' and 30" has a function similar to the main discharger 21. That is, the light emitting body 30, 30' and 30" forcibly lowers the electric potential of the photoreceptor web 20 before the photoreceptor web 20 is further charged. Thus, an unnecessary increase of the electric potential of the photoreceptor web 20 during additional charging can be restricted. The light emitting body 30, 30' and 30" emits light having a wavelength range of about 600–900 nm. Also, although three light emitting bodies 30, 30' and 30" are described in the first preferred embodiment, various modifications thereto are possible. That is, in a second preferred embodiment, the light emitting body is installed only between the developing unit 24*b* for the cyan color and the auxiliary charger 25*c* for the magenta color. Also, in a third preferred embodiment, one more light emitting body 30" is installed between the developing unit 24*a* for the yellow color and the auxiliary charger 25*b* for the cyan color. In a fourth preferred embodiment, the light emitting body 30 and 30' is installed downstream near each of the developing unit 24*b* for the cyan color and the developing unit 24*c* for the magenta color.

Figure 4:
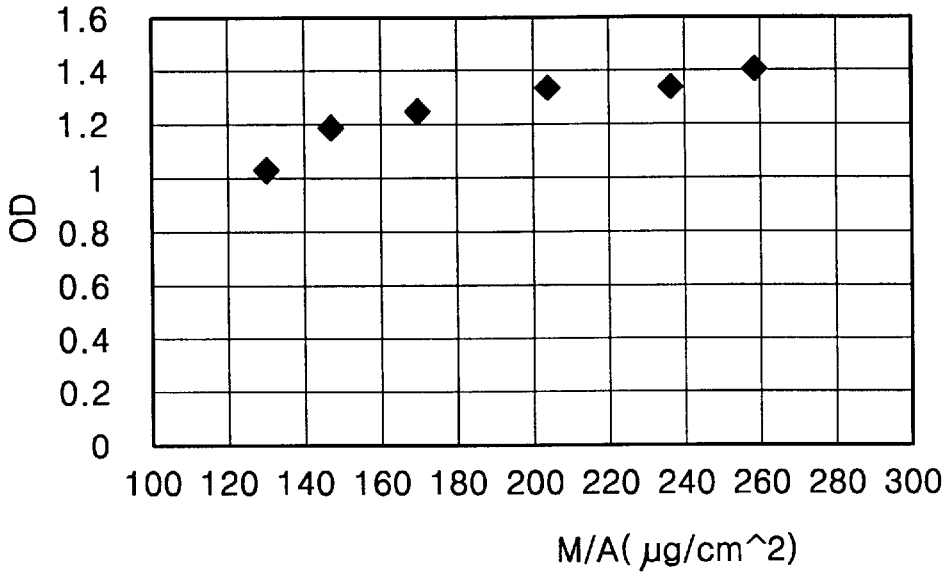
FIG. 4 is a graph showing the relationship between the concentration of toner in an image formed on a photoreceptor web and the mass per unit area of an image formed by the apparatus shown in FIG. 3.

FIG. 4 is a graph showing the proportional relationship between the concentration of an image (OD) and the mass per unit area (M/A) of the image developed on the photoreceptor web 20. Also, FIG. 5 is a graph showing the relationship between the mass per unit area (M/A) of the image and the strength of an electric field (hereinafter, referred to as E (V/$\mu$m)) which is generated due to the difference in the electric potential between the developing rollers and the photoreceptor web 20 for the respective development gaps $G_Y$, $G_C$, $G_M$ and $G_K$.

Referring to FIG. 4, the graph is based on the results of an experiment performed assuming that the appropriate OD of developer used for development is about 1.3. To get the OD of 1.3, the M/A must have an appropriate value of about 200–220 $\mu$g/cm$^2$. Considering experimental and operational errors, to prevent lowering of the OD below 1.3, the M/A of the image must not be lowered below 180 $\mu$g/cm$^2$, that is, below 90% of the appropriate value. Accordingly, to uniformly maintain the OD of a color image, the charged toner component must be controlled so that an amount of no more than 10% of the M/A of the image developed on the photoreceptor web 20 can be separated and transferred back to a developing roller. These conditions can be met by appropriately controlling the electric field at each development gap $G_Y$, $G_C$, $G_M$ and $G_K$.

Figure 5:
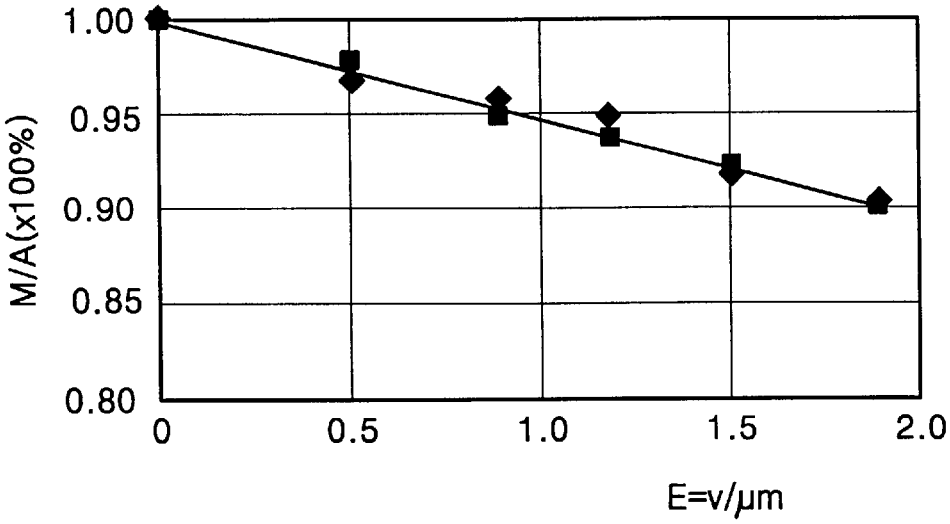
FIG. 5 is a graph showing the relationship between the strength of an electric field and the mass per unit area of an image at each development gap formed by the apparatus shown in FIG. 3.

That is, referring to FIG. 5, when the M/A is 90%, the value of E is 1.5–2.0. Thus, considering possible errors generated during experimentation and in the apparatus, to maintain the loss of the M/A within 10%, the value of E at each development gap $G_Y$, $G_C$, $G_M$ and $G_K$ must be maintained to be 1.5 or less. Preferably, to minimize the loss of the M/A, the value of E must be maintained to be 0.5 or less. The developer used in this experiment is typically used ink of which the amount of charge is about 300–700 $\mu$C/g. Also, each development gap has a size of about 50–300 $\mu$m. Thus, to obtain the value of E under these circumstances, the difference in the electric potential at each development gap must be maintained at about 150V and below.

Figure 6:
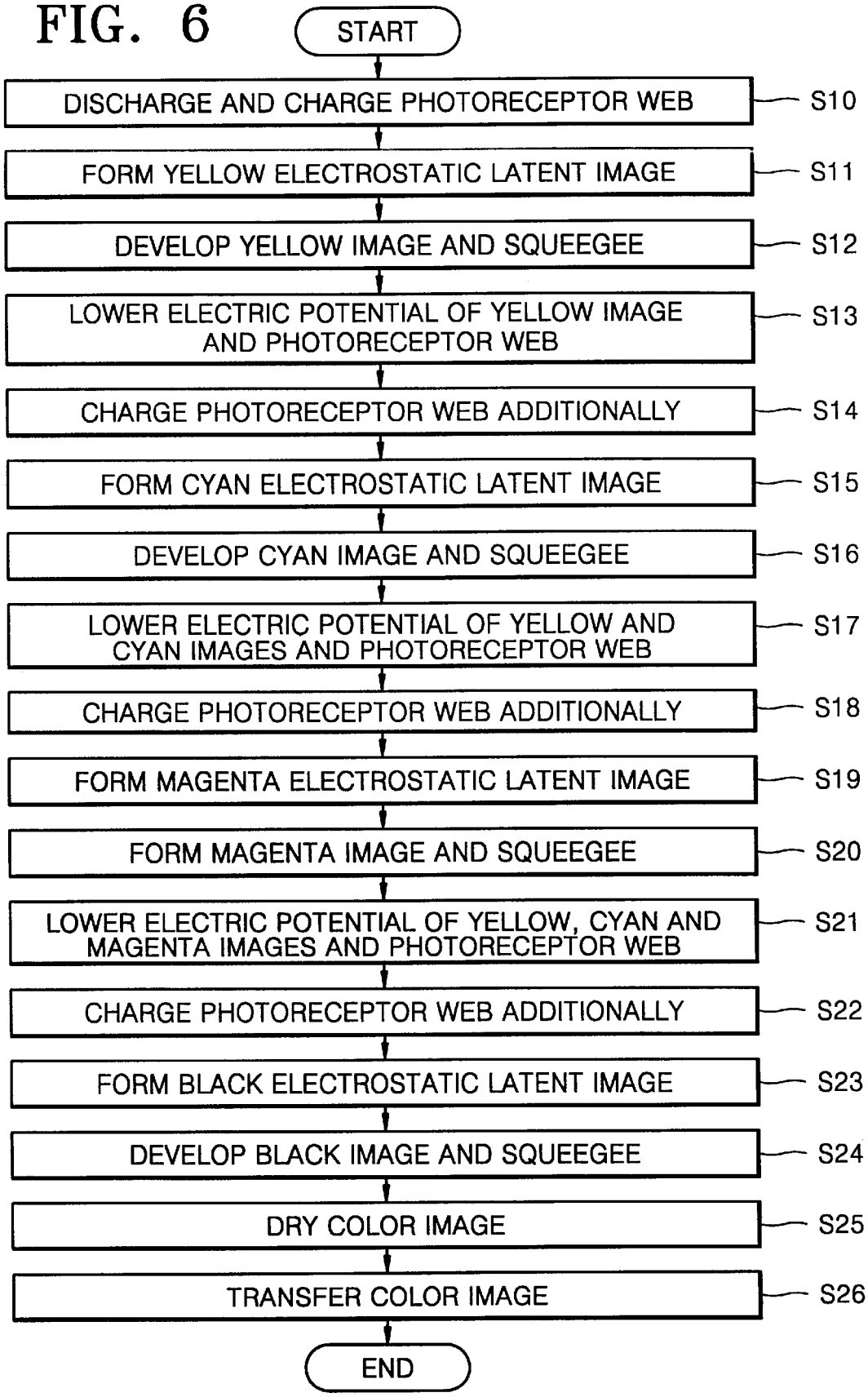
FIG. 6 is a flow chart for explaining a color image forming method according to a preferred embodiment of the present invention.

The method of forming a color image using the color image forming apparatus according to a preferred embodiment of the present invention is described referring to FIG. 6.

First, at the initial stage of a print mode, the surface of the photoreceptor web 20 which is circulated in one direction is initialized by the main discharger 21. Then, the photoreceptor web 20 is charged by the main charger 22 to a charging electric potential of about 650–700V (S10). When the photoreceptor web 20 is charged, an image formed on the photoreceptor web 20 is developed using developer corresponding to yellow, cyan, magenta and black colors according to information data of an input color image. For this purpose, when information data corresponding to each color is input, steps of exposure, development, squeegeeing, auxiliary discharging and additional charging are sequentially and repeatedly performed for each of the yellow, cyan, magenta and black colors.

Figure 1:
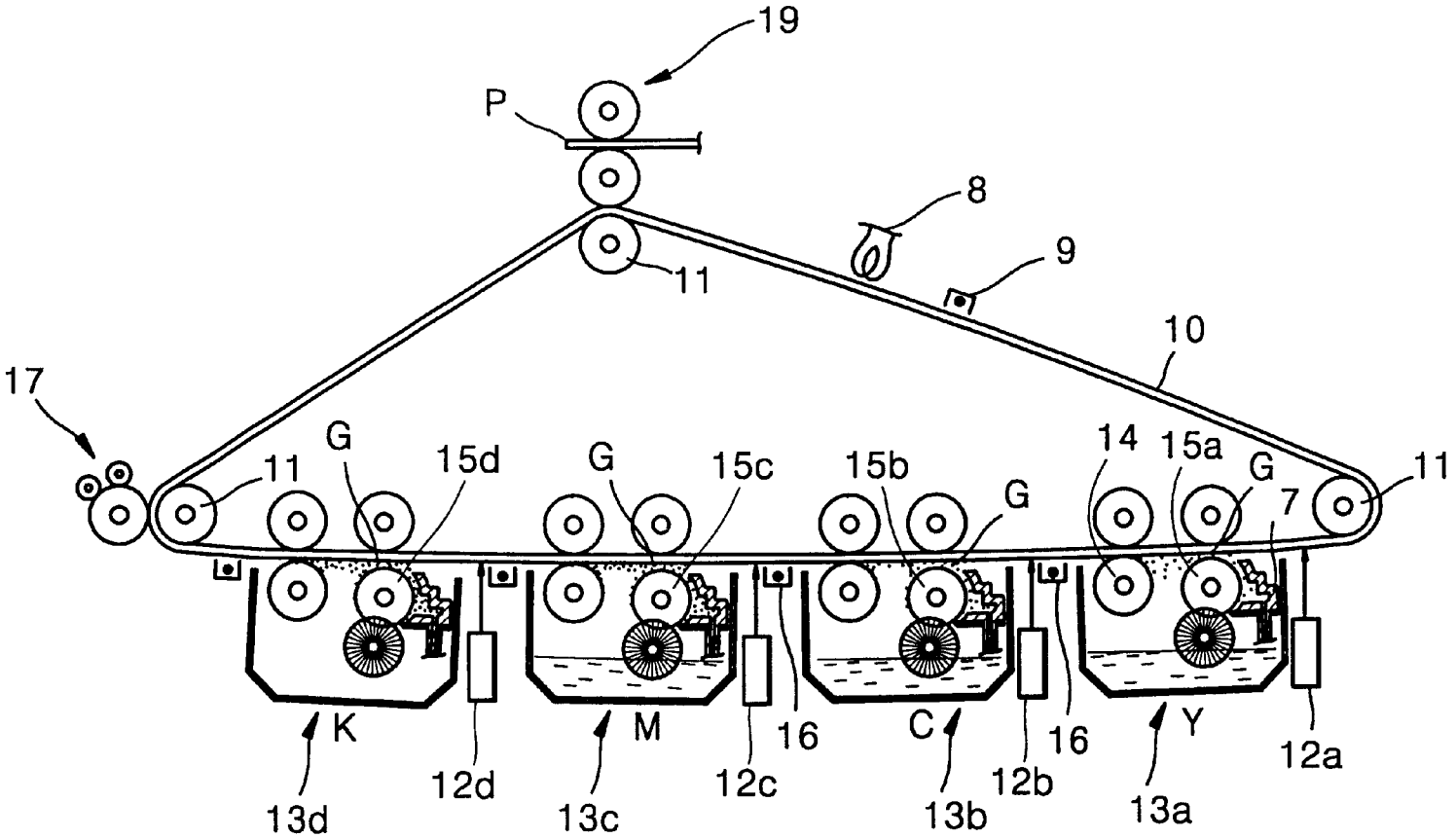
FIG. 1 (PRIOR ART)
FIG. 1 is a view showing the configuration of the conventional liquid electrophotographic color image forming apparatus.
Figure 2A:
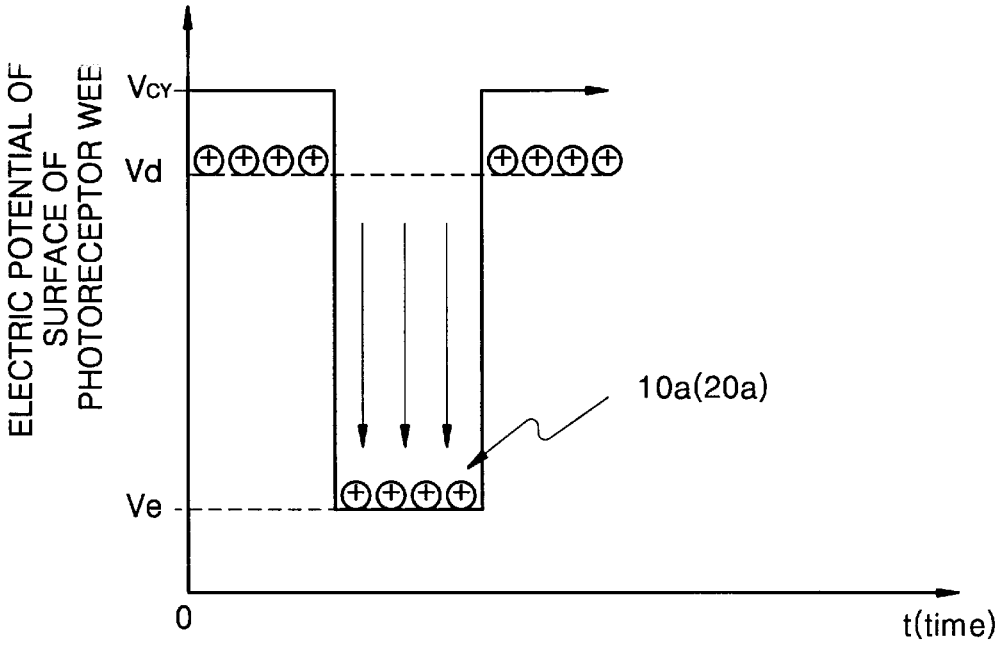
FIG. 2A (PRIOR ART)
FIGS. 2A through 2D are graphs showing models of the electric potential of the photoreceptor web according to the conventional color image forming method.
Figure 2B:
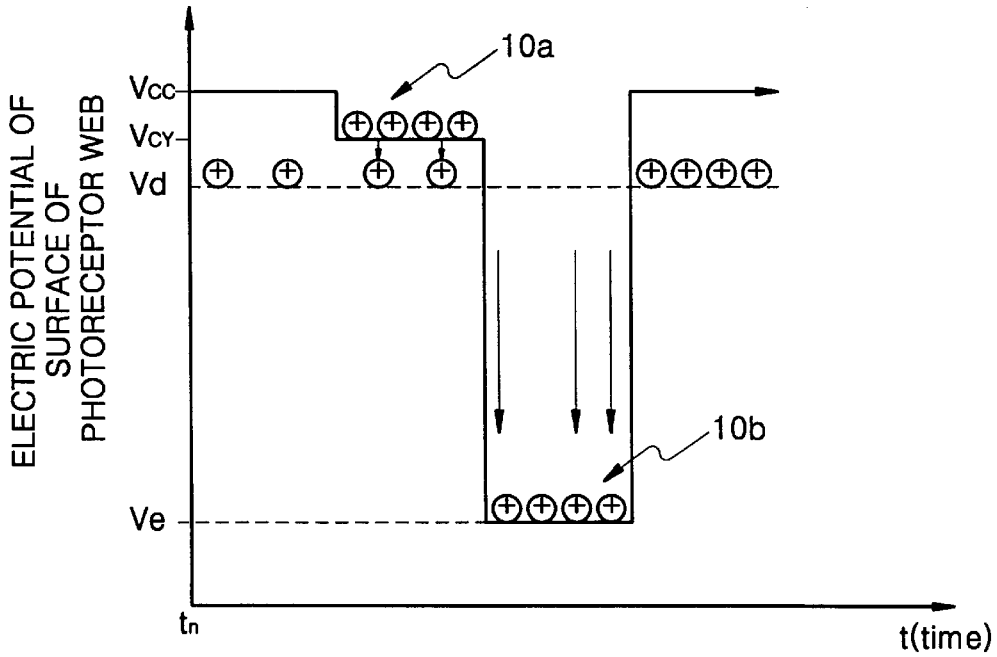
FIG. 2B (PRIOR ART)
Figure 2C:
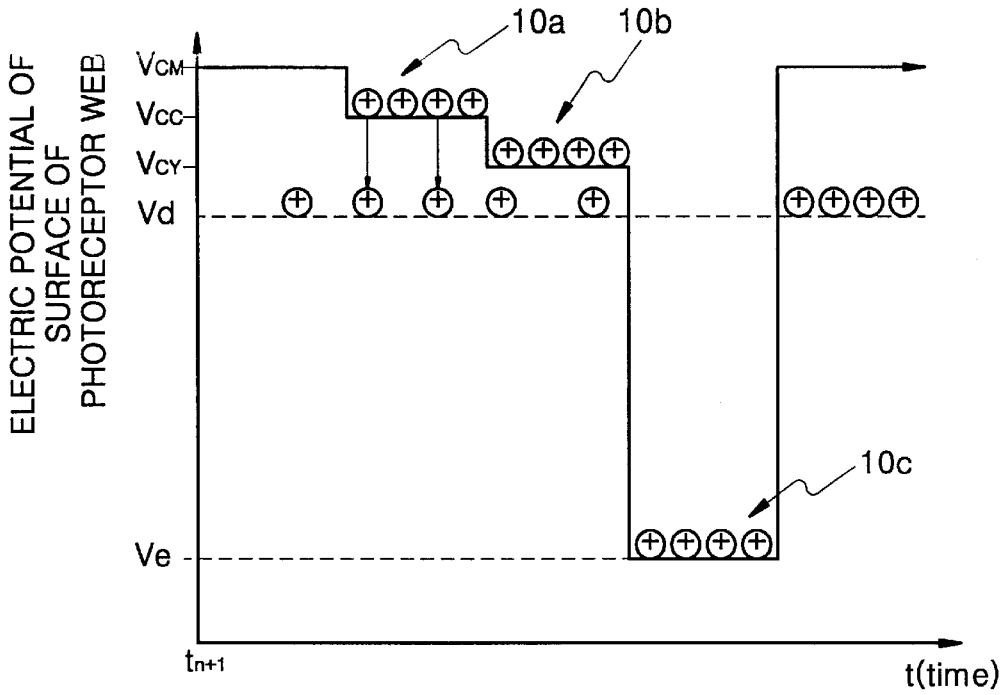
FIG. 2C (PRIOR ART)
Figure 2D:
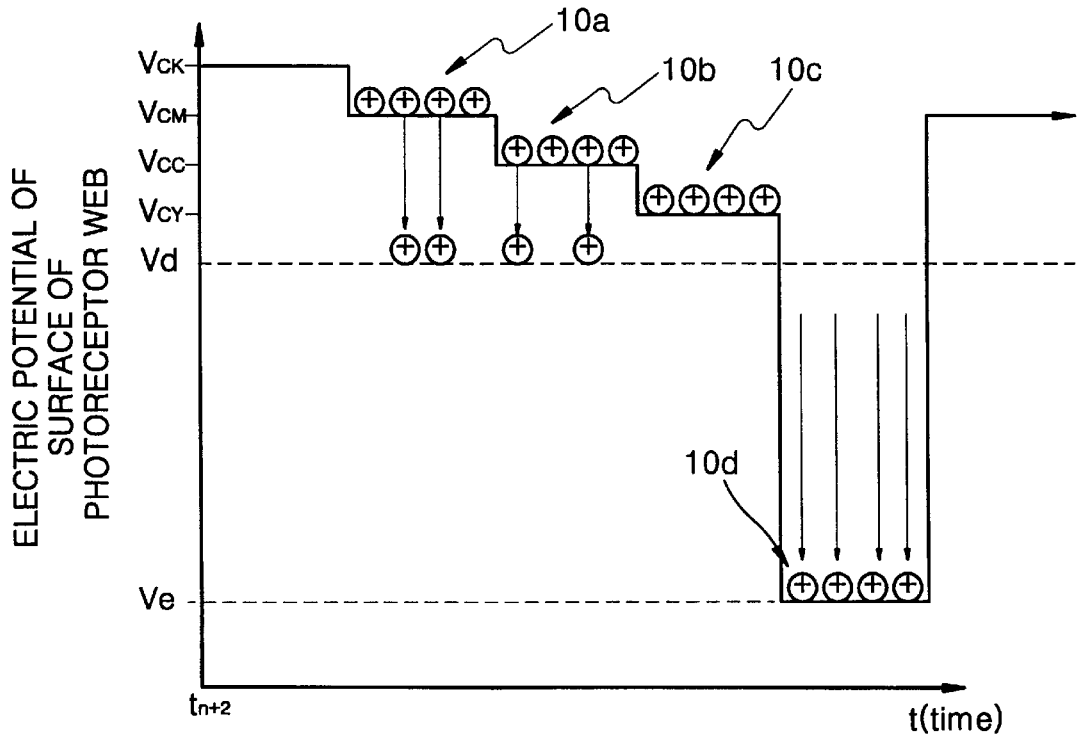
FIG. 2D (PRIOR ART)

In the development of the yellow color, referring to FIG. 2A, the optical scanning unit 23*a* for the yellow color scans light onto the photoreceptor web 20 and the charging electric potential $V_{CY}$ of the photoreceptor web 20 is changed to an exposure electric potential $V_e$ of about 120V. Then, a yellow electrostatic latent image corresponding to yellow image data is formed on the photoreceptor web 20 (S11). Next, the developing roller 28*a* for the yellow color is provided with a development electric potential $V_d$ of about 450V and a yellow developer, simultaneously. A charged toner component of the supplied developer moves to the yellow electrostatic latent image due to the difference in the electric potential between the development electric potential $V_d$ and the exposure electric potential $V_e$, and is used for development. Thus, a yellow image 20*a* is formed on the photoreceptor web 20.

Figure 7A:
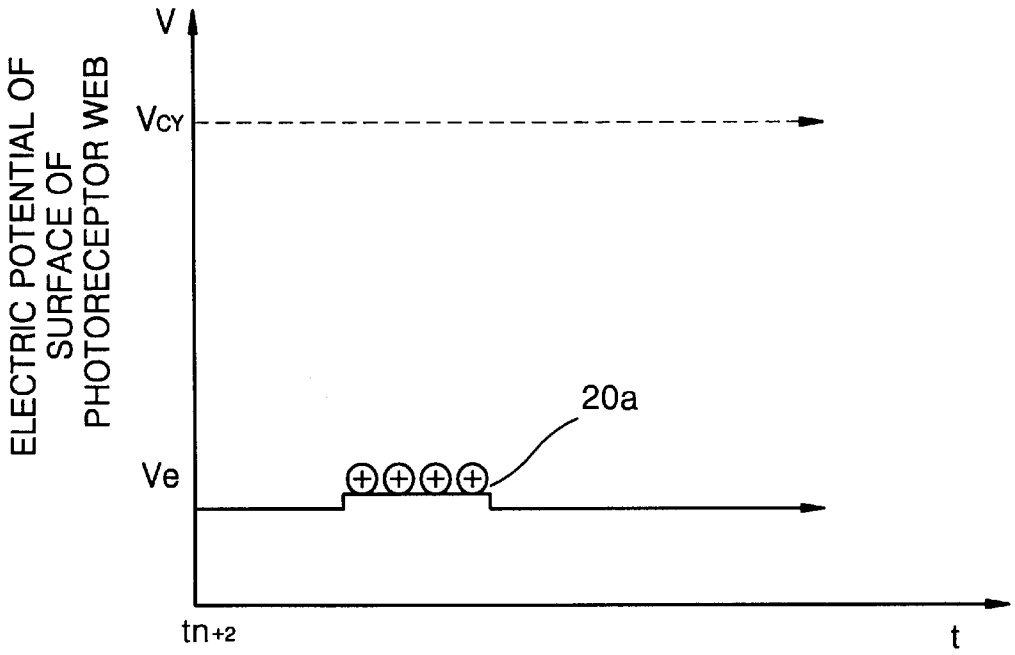
Figure 7B:
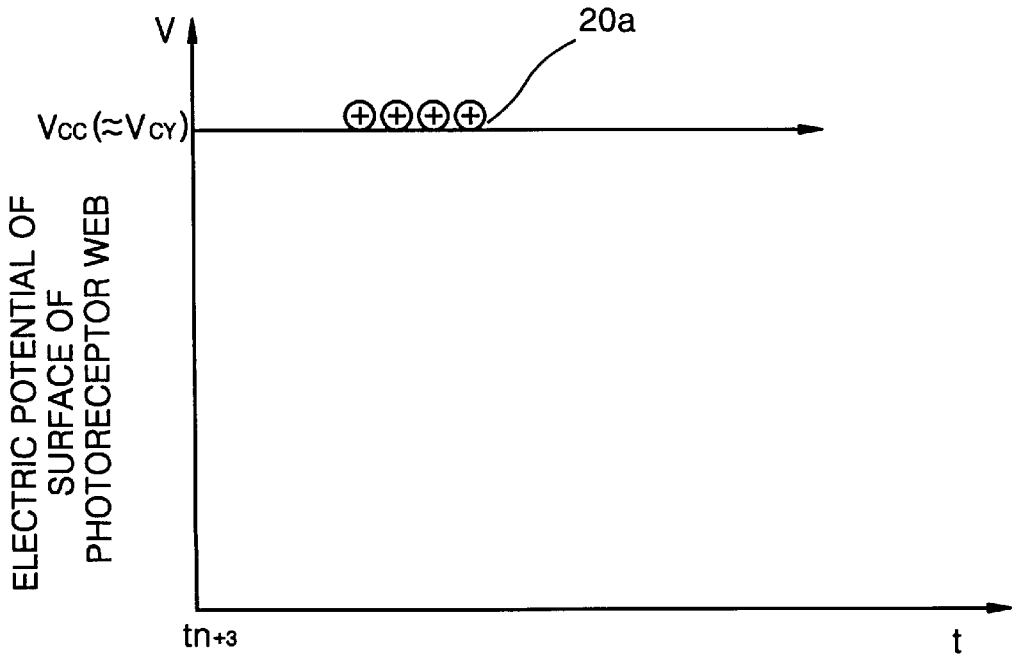

The yellow image is squeegeed by the squeegee roller 29'" installed close thereto, and most of the liquid carrier is removed (S12). After the yellow image is formed and squeegeed, the light emitting body 30" emits light having a wavelength of about 600–900 $\mu$m onto the photoreceptor web 20. The electric potential of a non-development portion of the photoreceptor web 20 and the yellow image 20*a* is forcibly lowered by the light of the light emitting body 30" to a uniform electric potential between 100–500V, as shown in FIG. 7A (S13). Then, the auxiliary charger 25*b* for the cyan color further charges the photoreceptor web 20 (S14). The electric potential of the further charged photoreceptor web 20 increases by about 100–500V to a uniform electric potential $V_{CC}$ between 650–700V, as shown in FIG. 7B. Here, the electric potential of the yellow image 20*a* also increases so that potential of the changed toner component increases.

Figure 8A:
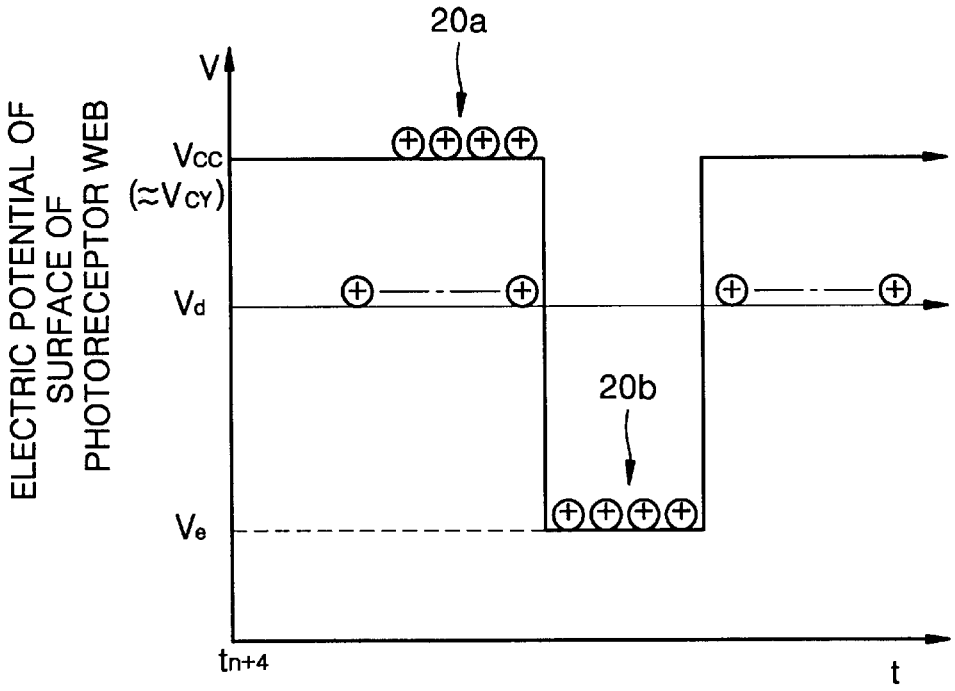

A cyan image is formed in the state in which the yellow image 20*a* and the non-development portion of the photoreceptor web 20 are at a uniform potential. To form the cyan image, the optical scanning unit 23*b* scans light onto the photoreceptor web 20. Then, as shown in FIG. 8A, the electric potential of the photoreceptor web 20 changes to the exposure electric potential $V_e$ to form a cyan electrostatic latent image corresponding to image data for the cyan color on the photoreceptor web 20 (S15). Next, in the state in which the exposure electric potential $V_e$ is applied to the cyan developing roller 28*b*, cyan developer is supplied to the cyan developing roller 28*b*. Then, a charged toner component of the cyan developer moves to the cyan electrostatic latent image due to the difference between the development electric potential $V_d$ and the exposure electric potential $V_e$ so that a cyan image 20*b* is formed. Here, the size of the development gap $G_C$ between the cyan developing roller 28*b* and the photoreceptor web 20 is the same as that of the development gap $G_Y$ in the previous step. However, since the difference between the development electric potential $V_d$ and the exposure electric potential $V_e$ is sufficiently large, the supplied cyan developer can move to the cyan electrostatic latent image without being affected. Also, when the difference in the electric potential at the development gap $G_C$ is extremely large, the yellow image 20*a* formed in the previous step may be transferred back to the developing roller 28*b* due to the difference in the development electric potential $V_d$. However, by controlling the difference of the electric potential at the development gap $G_C$ to stay within 150V, the wash-off phenomenon can be prevented.

Thus, the electric potential difference is maintained within 150V at the development gap $G_C$. Under this condition, the strength of E at the development gap $G_C$ satisfies the above predetermined condition that $E \leqq 0.5$. Thus, the electric field E is not strong enough to cause the charged toner component of the yellow image 20*a* to be transferred back to the developing roller 28*b*. Accordingly, the wash-off phenomenon, in which the charged toner component of the yellow image 20*a* is transferred back, hardly ever occurs. As a result, lowering of the concentration of yellow toner in the image 20*a* can be prevented.

Also, the magnitude of E is inversely proportional to the size of the development gap $G_C$. Here, the size of the development gap $G_C$ is greater than that of the development gap $G_Y$. Thus, even though the additionally charged charging electric potential $V_{CC}$ of the photoreceptor web 20 slightly increases above the initial charging electric potential $V_{CY}$, E at the development gap $G_C$ is maintained to be almost constant, due to the increased development gap $G_C$.

Also, when E has a value of 1.5 or below, some toner component of the yellow image 20*a* is separated and may be transferred back to the developing roller 28*b*. However, as described with reference to FIGS. 4 and 5, the mass per area (M/A) of the yellow image 20*a* which is transferred back remains within about 10%. Thus, little loss occurs and in the yellow image 20*a* a substantially uniform concentration can be maintained.

Figure 8B:
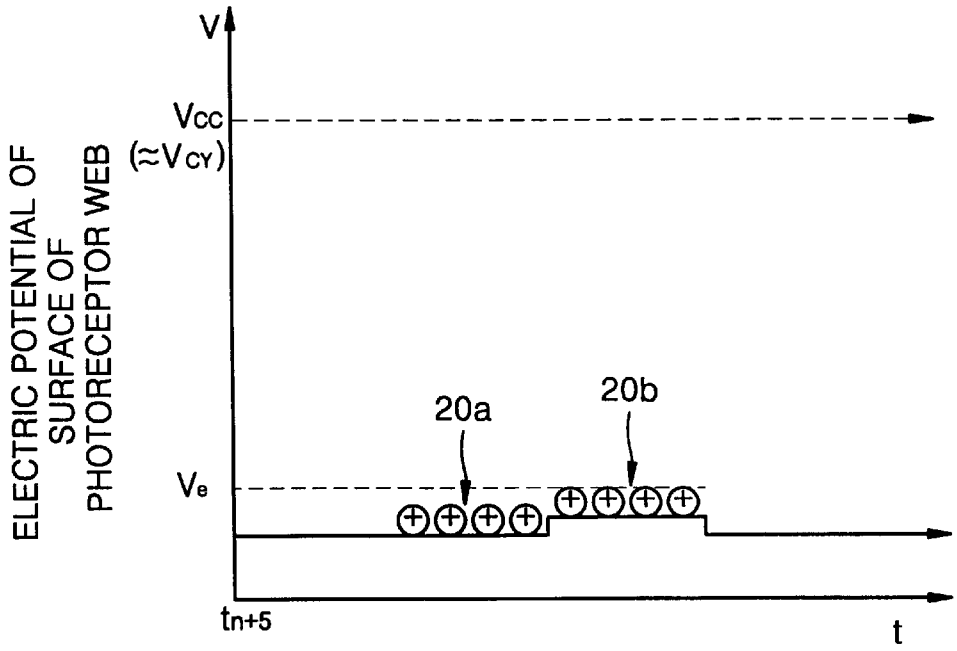
Figure 8C:
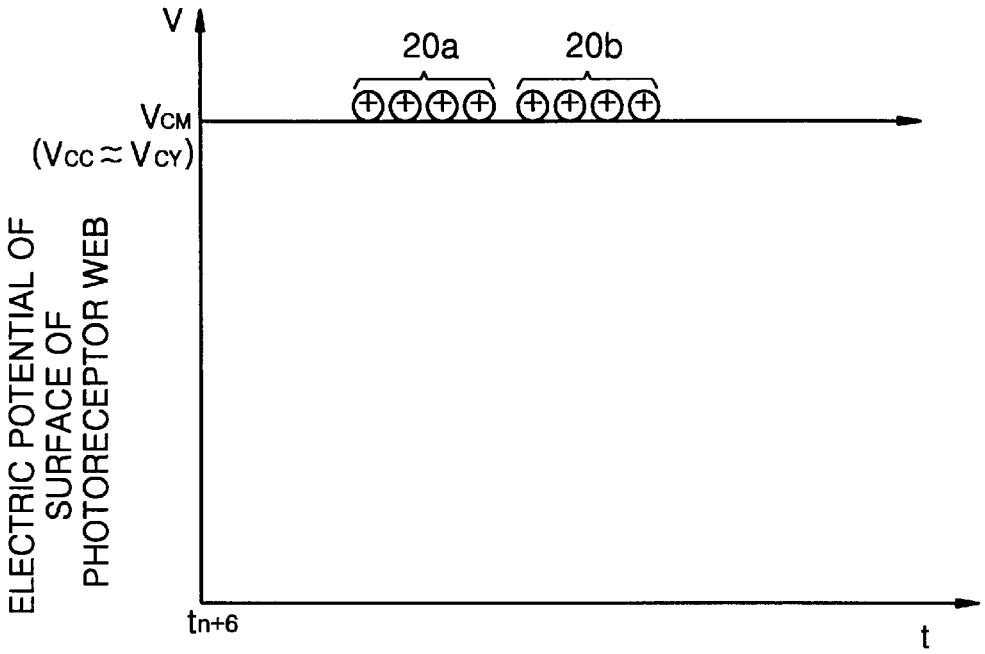
Figure 8C:
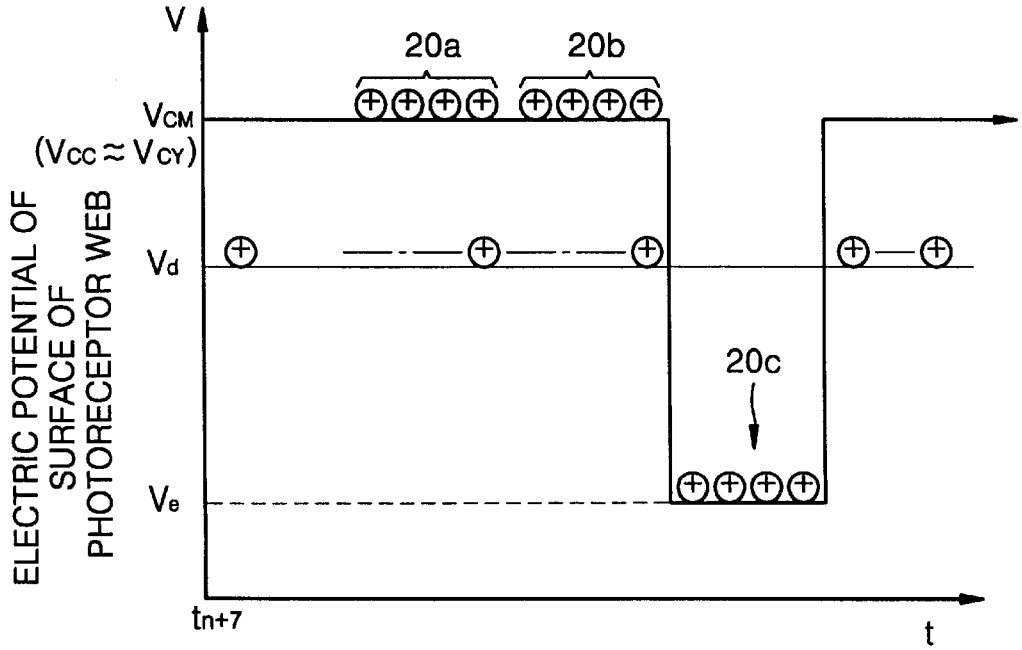

Next, a cyan image 20*b* in which most carrier has been removed by the squeegee roller 29" remains on the photoreceptor web 20 together with the yellow image. As in the previous steps S13 and S14, the surface of the photoreceptor web 20 containing the yellow and cyan images 20*a* and 20*b* is discharged by light emitted from the light emitting body 30', as shown in FIG. 8B, and the electric potential thereof is forcibly lowered (S17). Then, the cyan auxiliary charger 25*b* further charges the photoreceptor web 20. The surface of the photoreceptor web 20 of which electric potential has been forcibly lowered is further charged, as shown in FIG. 8C (S18). Then, the electric potential of the yellow image 20*a*, the cyan image 20*b* and a non-image portion of the photoreceptor web 20 turns to a charging electric potential $V_{CM}$ within an almost uniform level of 650–700V.

In this state, to next form a magenta image, as in the previous steps of S11 and S15, the optical scanning unit 23*c* for the magenta color scans light onto the photoreceptor web 20. As shown in FIG. 9A, part of the surface of the photoreceptor web 20 changes to the exposure electric potential $V_e$ and a magenta electrostatic latent image corresponding to image data for the magenta color is formed (S19). The formed magenta electrostatic latent image is developed by magenta developer which is supplied to the developing roller 28*c* for the magenta color and then transferred to the magenta electrostatic latent image due to the difference in the electric potential at the development gap $G_M$. Thus, a magenta image 20*c* is formed on the magenta electrostatic latent image (S20). Here, the development gap $G_M$ is greater than the development gap $G_C$. Thus, when the difference in the electric potential at the development gap $G_M$ slightly increases, by no more than 150 V, due to the additional charging by the magenta auxiliary charger 25*c*, the magenta developer is not prevented from moving to the magenta electrostatic latent image, and the intensity of the E at the development gap $G_M$ does not increase. Therefore, even when additional charging is performed at steps S14 and S18 in the case of a yellow image 20*a*, the strength of E does not increase at the development gap $G_M$. Accordingly, the charged toner component of the yellow image 20*a* does not receive a sufficient force to move it back to the magenta developing roller 28*c*.

The electric potential of the yellow image 20*a* slightly increases due to the two additional charging steps so that a small amount of toner component can be transferred back to the magenta developing roller 28*c*. However, a toner amount of 10% or more, which can affect the concentration of the image, is not transferred back.

Figure 9B:
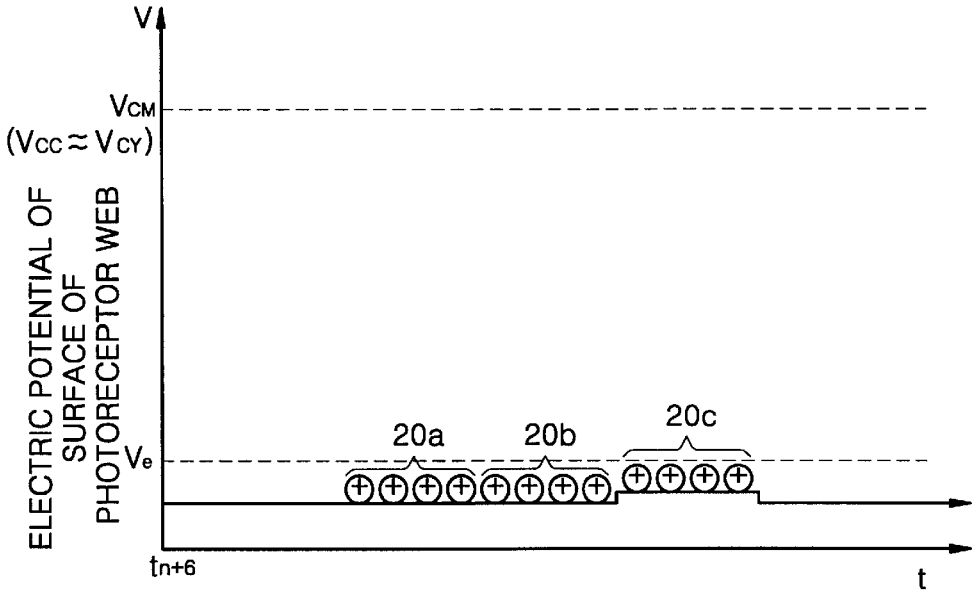
Figure 9C:
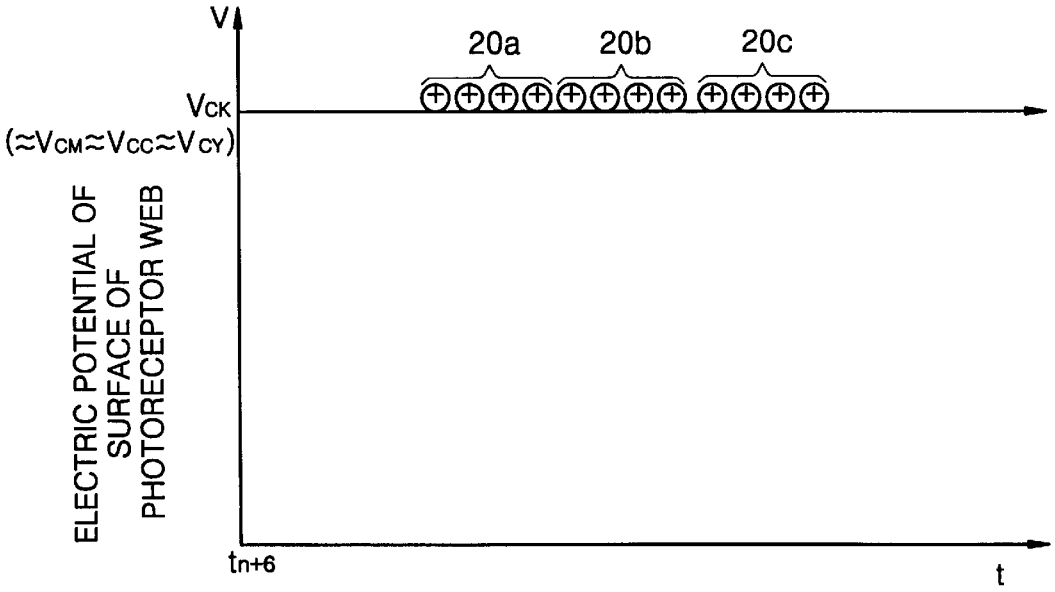

Next, the magenta image 20*c* is squeegeed by the squeegee roller 29' so that about 60–70% carrier thereof is removed (S20). Finally, the electric potential of the surface of the photoreceptor web 20 containing the yellow, cyan and magenta images 20*a*, 20*b* and 20*c* is lowered to a predetermined level by the light emitted by the light emitting body 30, as shown in FIG. 9B (S21). Then, the auxiliary charger 25*d* for the black color further charges the photoreceptor web 20 (S22). The electric potential of the photoreceptor web 20 containing the yellow, cyan and magenta images 20*a*, 20*b* and 20*c* increases to a uniform charging electric potential $V_{CK}$ between 650–700V, as shown in FIG. 9C.

Figure 10A:
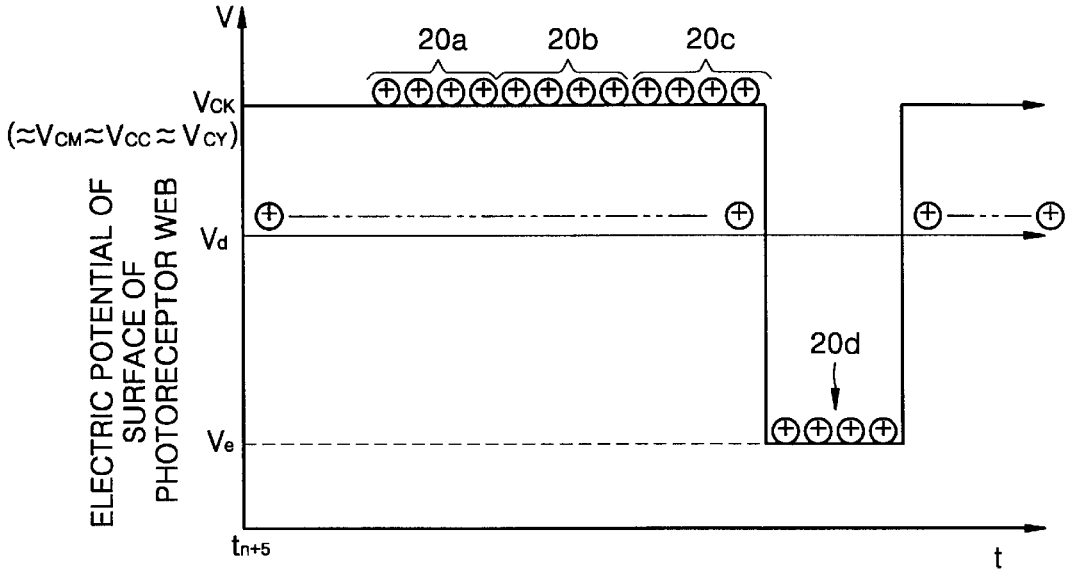
Figure 10B:
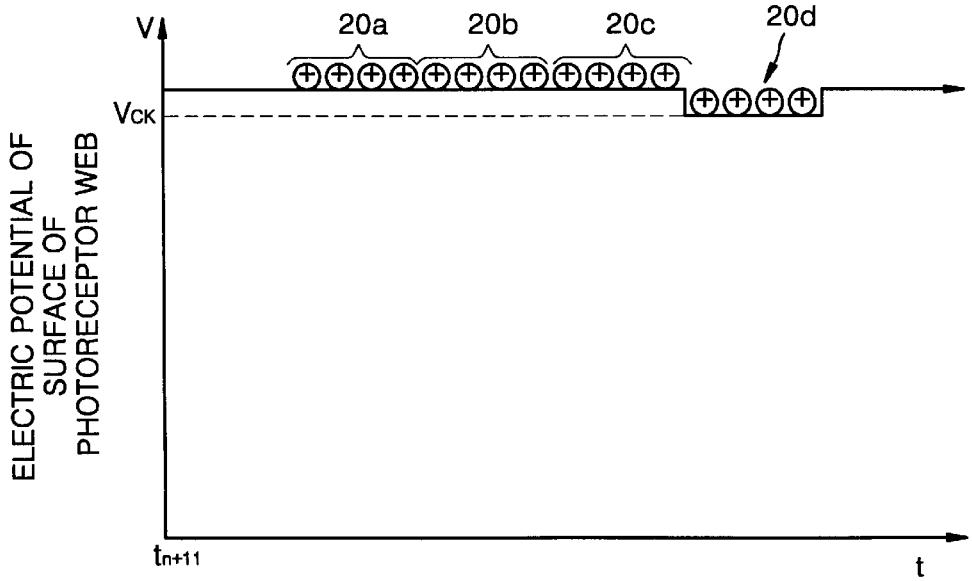

In this state, to form a black image, the optical scanning unit 23*d* for the black color scans light onto the photoreceptor web 20 and a black electrostatic latent image corresponding to image data for the black color is formed (S23). Then, the development electric potential $V_d$ is applied to the developing roller 28*d* for the black color and black developer is supplied. Then, a charged toner component of the black developer is transferred to the black electrostatic latent image due to the difference between the development electric potential $V_d$ and the exposure electric potential $V_e$ of the black electrostatic latent image. The transferred toner component forms a black image 20*d*, as shown in FIG. 10A (S24). Here, even when the electric potential of the yellow, cyan and magenta images 20*a*, 20*b* and 20*c* slightly increases after passing the steps of forming the yellow, cyan and magenta images 20*a*, 20*b* and 20*c*, since the development gap $G_K$ is greater than the development gaps $G_Y$, $G_C$ and $G_M$, the strength of E is maintained to be almost the same as in the previous steps. Thus, the charged toner components of the respective yellow, cyan and magenta images 20*a*, 20*b* and 20*c* are not transferred back to the black developing roller 28*d* due to the electric field E. Actually, a small amount of charged toner component may be separated from each of the yellow, cyan and magenta images 20*a*, 20*b* and 20*c*. However, the separated amount is merely within 10% of the total amount, which is negligible. Thus, the formed black image 20*d* is squeegeed by the squeegee roller 29. Finally, all of the yellow, cyan, magenta and black images 20*a*–20*d* are developed and a complete color image is formed. A topping corona 25*e* installed at the downstream of the black image unit 24*d* finally charges the photoreceptor web 20, thus increasing the naturally attenuated electric potential of the respective images 20*a*–20*d* and the photoreceptor web 20. The magenta image 20*d*, as shown in FIG. 10B, has almost the same electric potential as each of the images 20*a*, 20*b* and 20*d* according to the balance of charge. The color image is dried while passing the drying unit 26 and thus liquid carrier which is not removed in the squeegeeing step is lost (S25). The dried color image is transferred to the transfer roller 27*a* due to the surface energy and finally printed on a sheet of paper P passing between the transfer roller 27*a* and the fusing roller 27*b*. In this way, a color image having a desired concentration is printed (S26).

As described above, in the liquid electrophotographic color image forming apparatus according to the present invention and a color image forming method thereof, the intensity of electric field at each development gap can be maintained to be constant. Thus, charged toner constituting the image formed in the previous step can be prevented from being transferred to the developing roller in the next step. Accordingly, since an appropriated value for the concentration of a color image is maintained, a printed image of a desired concentration can be obtained. Also, by drastically reducing the amount of the toner component which is subject to wash-off, the developer in each of the developing units can be prevented from being contaminated and thus maintenance expenses can be reduced.

It is contemplated that numerous modifications may be made to the apparatus and method of the present invention without departing from the spirit and scope of the invention as defined in the claims.

What is claimed is:

1. A liquid electrophotographic color image forming apparatus comprising:

a photoreceptor web, which is operative to circulate;

a main charger for charging a surface of the photoreceptor web to a predetermined charging electric potential;

an optical scanning unit for scanning light onto the photoreceptor web to form an electrostatic latent image;

developing rollers for yellow, cyan, magenta and black colors, sequentially installed in a direction that the photoreceptor web circulates, the developing rollers developing the electrostatic latent image using developer for each color;

auxiliary chargers for the cyan, magenta and black colors, respectively installed downstream of each of the developing rollers, which additionally charge the photoreceptor web, an electric potential of which is lowered after development for each of the yellow, cyan and magenta colors; and development gaps between each of the developing rollers and the photoreceptor web which are respectively defined as $G_Y$, $G_C$, $G_M$ and $G_K$ and are sequentially disposed in the direction that the photoreceptor web circulates;

wherein the development gaps are operative to restrict an increase of an intensity of an electric field at each development gap according to the additional charge; and wherein each of the developing rollers are installed to satisfy the following condition:

$$G_Y<G_K.$$

2. The apparatus as claimed in claim 1, further comprising at least one light emitting body, installed between one of the developing rollers and one of the auxiliary chargers, wherein the light emitting body forcibly lowers the electric potential of the photoreceptor web after passing the developing roller.

3. The apparatus as claimed in claim 2, wherein the light emitting body emits light having a wavelength range of about 600–900 nm.

4. The apparatus as claimed in claim 2, wherein the light emitting body is installed between the cyan developing roller and the magenta auxiliary charger.

5. The apparatus as claimed in claim 4, wherein another light emitting body is further installed between the magenta developing roller and the black auxiliary charger.

6. The apparatus as claimed in claim 4, wherein another light emitting body is further installed between the yellow developing roller and the cyan auxiliary charger.

7. The apparatus as claimed in claim 5, wherein another light emitting body is further installed between the yellow developing roller and the cyan auxiliary charger.

8. The apparatus as claimed in claim 1, wherein the development gaps $G_Y$ and $G_C$ are the same size.

9. The apparatus as claimed in claim 1, wherein the development gaps $G_M$ and $G_K$ are greater than the development gaps $G_Y$ and $G_C$ and are the same size.

10. The apparatus as claimed in claim 1, wherein a magnitude E (V/$\mu$m) of the electric field at each of the development gaps satisfies the following condition:

$$0<E<1.5.$$

11. A method of forming a color image comprising:

charging a photoreceptor web to a predetermined charging electric potential;

scanning light onto the photoreceptor web to sequentially form electrostatic latent images corresponding to respective colors of each of a plurality of optical scanning units installed in order of yellow, cyan, magenta and black colors;

sequentially developing the electrostatic latent images using yellow, cyan, magenta and black developer applied from yellow, cyan, magenta and black developing rollers;

squeegeeing the developer used for the development by squeegee rollers, wherein one squeegee roller is installed downstream of each of the developing rollers;

additionally charging the photoreceptor web, which has a lowered electric potential, after squeegeeing using an auxiliary charger; and restricting the developer used for the development on the photoreceptor web from being transferred to a next developing roller by providing at least two differently sized development gaps.

12. The method as claimed in claim 11, wherein the restricting of developer from being transferred back to the next developing roller further comprises maintaining a magnitude of an electric field within a predetermined range at development gaps which are between each developing roller and the photoreceptor web.

13. The method as claimed in claim 12, wherein the maintaining of the magnitude of the electric field further comprises:

installing the developing rollers such that sizes of the development gaps which are respectively between each of the yellow, cyan, magenta and black developing rollers and the photoreceptor web can be increased; and maintaining a difference in an electric potential between the photoreceptor web and each of the developing rollers at each development gap to be 150V or less, and wherein an increase of the difference in the electric potential at each of the development gaps according to the additional charging is compensated for by an increase in size of individual development gaps.

14. The method as claimed in claim 11, wherein the maintaining of the magnitude of an electric field comprises lowering forcibly the electric potential of the photoreceptor web to a predetermined level before the photoreceptor web is additionally charged so that the electric potential of the photoreceptor web is constantly maintained whenever the photoreceptor web is additionally charged from passing each of the developing rollers.

15. The method as claimed in claim 14, wherein the lowering forcibly of the electric potential of the photoreceptor web is performed by using a light emitting body which emits light having a wavelength range of about 600–900 $\mu$m and is installed between the squeegee roller and the auxiliary charger.

16. The method as claimed in claim 11, wherein a magnitude E (V/$\mu$m) of the electric field satisfies the following condition:

$$0<E<1.5.$$

17. A method of forming a color image comprising:

charging a photoreceptor web to a predetermined charging electric potential;

scanning light onto the photoreceptor web to sequentially form electrostatic latent images corresponding to respective colors of each of a plurality of optical scanning units installed in order of yellow, cyan, magenta and black colors;

sequentially developing the electrostatic latent images using yellow, cyan, magenta and black developer applied from yellow, cyan, magenta and black developing rollers;

squeegeeing the developer used for the development by squeegee rollers, wherein one squeegee roller is installed downstream of each of the developing rollers;

additionally charging the photoreceptor web, which has a lowered electric potential, after squeegeeing using an auxiliary charger; and restricting the developer user for the development on the photoreceptor web from being transferred to a next developing roller, wherein the restricting of developer from being transferred back to the next developing roller further comprises maintaining a magnitude of an electric field within a predetermined range at development gaps which are between each developing roller and the photoreceptor web, and wherein the maintaining of the magnitude of the electric field further comprises:

installing the developing rollers such that sizes of the development gaps which are respectively between each of the yellow, cyan, magenta and black developing rollers and the photoreceptor web can be increased; and maintaining a difference in an electric potential between the photoreceptor web and each of the developing rollers at each development gap to be 150V or less, and wherein an increase of the difference in the electric potential at each of the development gaps according to the additional charging is compensated for by an increase in size of individual development gaps.

* * * * *